United States Patent [19]

Weisinger

[11] Patent Number: 4,731,957

[45] Date of Patent: Mar. 22, 1988

[54] KNIFE SHARPENER

[76] Inventor: Martin D. Weisinger, 6327 Mesita Dr., San Diego, Calif. 92115

[21] Appl. No.: 2,279

[22] Filed: Jan. 12, 1987

[51] Int. Cl.[4] ..... B24D 15/08

[52] U.S. Cl. ..... 51/205 WG; 51/214; 76/88; 76/86; 76/82

[58] Field of Search ..... 51/214, 205 R, 205 WG, 51/211, 212, 285; 76/82, 82.2, 83, 88, 86

[56] References Cited

U.S. PATENT DOCUMENTS

| | | | |
|---|---|---|---|
| 606,000 | 6/1898 | Clark | 76/88 |
| 665,895 | 1/1901 | Foster | 76/88 |
| 833,499 | 10/1906 | Baries | 76/88 |
| 942,172 | 12/1909 | Hawks | 76/88 |
| 1,531,005 | 3/1925 | Hartley | 76/88 |
| 2,885,836 | 5/1959 | Robitaille | 51/214 |
| 3,861,087 | 1/1975 | Martin | 51/212 |
| 4,418,588 | 12/1983 | Byers | 76/88 |
| 4,510,824 | 4/1985 | Byers | 51/214 |

*Primary Examiner*—Frederick R. Schmidt
*Assistant Examiner*—Robert A. Rose
*Attorney, Agent, or Firm*—Frank D. Gilliam

[57] ABSTRACT

The invention is directed to a blade sharpening device formed from two mating longitudinal body portions. An opening is provided at one end of the sharpening device from which the apex of an equilateral triangular shaped cutting blade extends into the opening. The inside corners of the opening walls and the back wall of recesses in each body portion lock the cutter blade in position and prevent movement there of when in use for sharpening. The cutter blade can be rotated to provide a new cutting edge. Extra cutter blades can be stored within the mating body portions. A thumb guard may be included.

6 Claims, 5 Drawing Figures

KNIFE SHARPENER

BACKGROUND OF THE INVENTION

1. Field of Use

This invention relates generally to a knife sharpener hand held or held in position by clamping or the like to a fixed object and, particularly to a knife sharpening device that can be used by persons of varying degrees of skill in sharpening knives and the like to produce a precision edge to the blade sharpened thereby.

2. Description of the Prior Art

The prior art discloses many examples of hand-held sharpeners for kitchen knives or the like (see U.S. Pat. Nos. 62,472; 605,289; and 4,494,340 for examples) an many examples of sharpening devices for other items (see U.S. Pat. Nos. 1,963,442; 2,398,560 and 2,800,040, for examples).

U.S. Pat. Nos. 605,289 and 1,963,422 teach the use of circular cutting blades and U.S. Pat. Nos. 62,472; 2,398,560 and 2,800,040 teach linear cutting blades.

SUMMARY OF THE INVENTION

In accordance with the invention there is provided an improved knife sharpener for sharpening knives which is hand-held and requires little or no skill for its use to produce an expertly sharpened edge to a knife.

The knife sharpener generally comprises two handle or body portions, a cutter blade of equilateral triangular configuration securely locked between the handle or body portions and extending from the interior of the body portion through an opening on one end of the handle or body portion. The extended or apex portion of the cutter blade is positioned within the opening whereby a blade of a knife or the like can be drawn between the edge of the opening and one side of the cutter blade for sharpening the blade edge. The cutter blade is chamfered or angled along its edges to provide the proper slope to the blade edge being sharpened. The cutter blade can be rotated to expose new cutting surfaces. The handle or body portion may be hollow for containing additional or extra cutter blades.

A knife sharpener in accordance with the present invention offers several advantages over the prior art. For example, the cutter blade is self-positioning to the correct cutting angle and may be rotated to expose new cutting edges. This is made possible by cutouts within the handle or body portions that properly positions and locks the cutter blade in place. The apex of the cutter blade is centered between two extending arms formed on one end of the body of the device. These arms provide a proper reference angle between their inner surfaces and cutter blade cutting surface for the knife blade edge to be sharpened at a proper angle and prevents undesired physical contact with the cutter blade edges thus preventing injury to the user and/or damage to the cutter blade. A guard is provided in one embodiment to prevent inadvertent injury to the thumb of the user by the blade being pulled through the sharpener. Other objects and advantages of the invention will hereinafter appear.

DETAILED DESCRIPTION OF THE DRAWINGS

Figure 1:
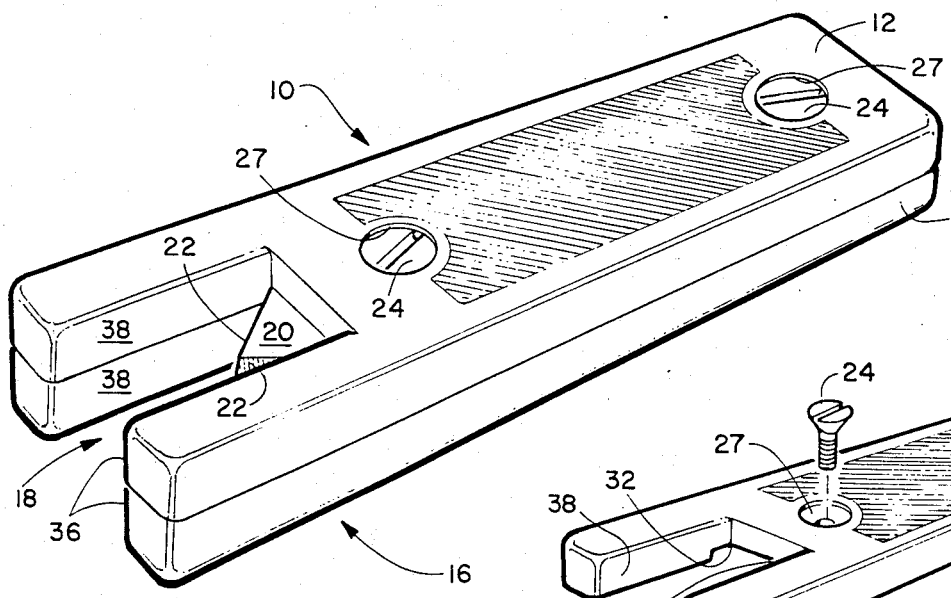
FIG. 1 is a perspective elevated view of the sharpening device of the invention.

Referring now to the various drawing Figures. FIG. 1 depicts the blade sharpening device 10 of the invention. The device comprises mating body portions 12 and 14. The body portions may be constructed from any material suitable for the purpose intended. Aluminum or other light weight metal or plastic of various types may be used. The body portion may be machined, cast or formed by any other known method for forming materials.

End 16 of the blade sharpening device includes a cutout 18 within which an equilateral triangular shaped cutter blade 20 extends from between the body portions. The edges 22 of the cutter blade 20 are chamfered or angled toward one side of the blade.

The body portions 12 and 14 are secured together by means of a pair of countersunk type screws 24.

Figure 2:
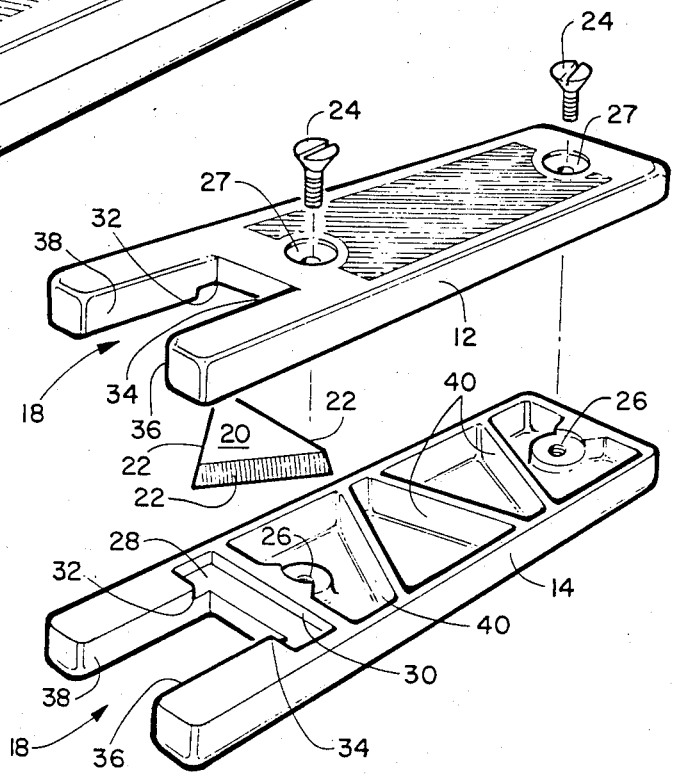
FIG. 2 is an exploded view of the device of FIG. 1.
Figure 3:
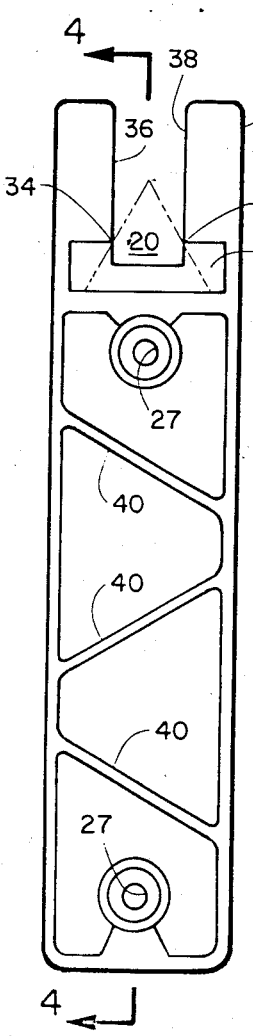
FIG. 3 is a bottom plan view of one of the handle or body portion of the devices of FIGS. 1 and 2.
Figure 4:
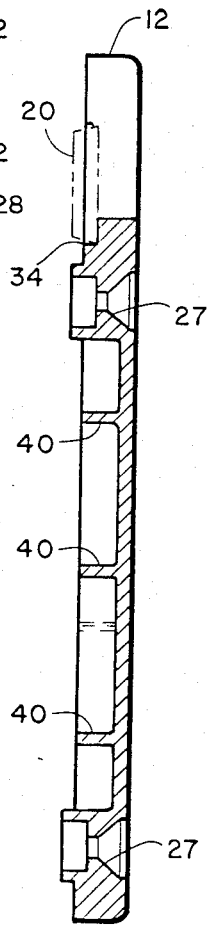
FIG. 4 is a section of the handle or body portion of FIG. 4 taken along line 4—4 thereof.

As can be clearly seen in FIG. 2, the threaded screws 24 extend through an angled aperture 27 in portion 12 and thread into engaging thread 26 in portion 14. A mating cutout 28 is formed in both body portions 12 and 14 for receiving the cutter blade 20 in a locking engagement with the body portions along side 30 and corners 32 and 34. When the cutter blade is installed as shown in FIG. 1 and in phantom in FIGS. 3 and 4 and the body portions 12 and 14 are assembled, the side 30 and corners 32 and 34 lock the cutter blade 20 into operating position and prevent any movement of the cutter blade 20 when a knife blade (not shown) or the like is drawn through the cutout 18 between either wall 36 or 38 and edges 22 of the cutter blade 20 for sharpening thereof.

As blade edges 22 wear, the body portions can be separated as shown in FIG. 2 and the blade 20 can be rotated in position to expose one new surface 22 to the opening 18 plus an unused portion of the other surface. The cutter blade 20 can be periodically rotated in this manner until all surfaces 22 are no longer suitable for the purpose intended at which time a new cutter blade 20 can be inserted into the opening 28.

Depending on the materials of construction the inner surfaces of the body portions may be hollow to conserve materials of construction. When constructed in this manner strengthening walls 40 are employed. The space between the various walls 40 and outside walls are suitable for the storing of extra cutter blades 20.

To provide a good grip on the body portion when sharpening knife blade and the like, a roughened portion 42 may be provided on the outer surface of each body portion. The roughening portion 42 may be machined or cast into the body portions during fabrication or coated thereon after fabrication as desired.

The cutter blade 20 is preferrably constructed of carbide or is carbide coated. Blades of this type are available from Enco Company as model TPG-322. Suitable blades from other manufactures or distributors can be used equally as well to practice the invention.

Figure 5:
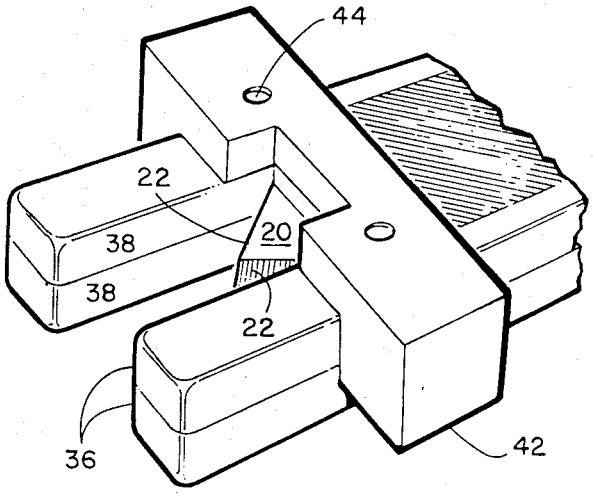
FIG. 5 is a section of the device of FIG. 1 with the addition of a thumb guard.

FIG. 5 depicts an end section of the device 16 of FIG. 1 with the addition of a thumb guard 42 which is secured to at least one portion 16 by means of fastening means 44. The fastening means typically will be screws passing through the thumb guard 42 and engaging threads on portion 36, or by casting the guard integrally with one portion of 16. The guard 42 extends from the adjacent portion 36 on the side adjacent the chamfered surface of the blade 20 providing a guard for the thumb of the user when the blade is pulled toward the hand of the user.

Other variations, applications and ramifications of this invention will occur to those skilled in the art upon reading this disclosure. Those are intended to be included within the scope of this invention, as defined in the appended claims.

What is claimed is:

1. A blade sharpening device comprising:

a body member comprising two longitudinal body portions which are secured together by fastening means, said body member having a handle portion at one end and two parallel spaced apart extending arms on a second end thereof:

an equilateral triangular shaped blade extending from said body portion into an open area between said two parallel spaced apart extending arms with an apex of said cutter blade centrally positioned within said open area; and locking means for locking said cutter blades in a fixed position relative to said body member, said locking means comprising an elongated rectangular opposing slot in each of said body portions, said elongated rectangular slot extending in a direction transverse to said parallel extending arms thereby forming an opening to said slot from said open area, said cutter blade being positioned in said slot so that the surface of said slot opposite said opening and the edges of said opening lock said cutter blade in position.

2. The invention as defined in claim 1 wherein the handle portion includes a roughened gripping surface.

3. The invention as defined in claim 1 wherein the edges of said cutter blade are chamfered.

4. The invention as defined in claim 1 wherein the inner surface of said body portions include hollowed out areas defined by rib members.

5. The invention as defined in claim 1 further comprising a thumb guard positioned transverse to a longitudinal axis of the handle portion.

6. The invention as defined in claim 3 further comprising a thumb guard positioned transverse to a longitudinal axis of the handle portion on a side of the handle portion adjacent to the chamfered surface of the cutter blade.

* * * * *